US011384997B2

(12) United States Patent
Maeda et al.

(10) Patent No.: US 11,384,997 B2
(45) Date of Patent: Jul. 12, 2022

(54) HEAT EXCHANGER, HEAT EXCHANGER UNIT, AND REFRIGERATION CYCLE APPARATUS

(71) Applicant: Mitsubishi Electric Corporation, Tokyo (JP)

(72) Inventors: Tsuyoshi Maeda, Tokyo (JP); Akira Yatsuyanagi, Tokyo (JP); Tomohiko Takahashi, Tokyo (JP); Yoshihide Asai, Tokyo (JP); Hidetomo Nakagawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/048,668

(22) PCT Filed: Jun. 13, 2018

(86) PCT No.: PCT/JP2018/022575
§ 371 (c)(1),
(2) Date: Oct. 19, 2020

(87) PCT Pub. No.: WO2019/239519
PCT Pub. Date: Dec. 19, 2019

(65) Prior Publication Data
US 2021/0180878 A1 Jun. 17, 2021

(51) Int. Cl.
*F28F 1/32* (2006.01)
*F28D 1/053* (2006.01)
*F28D 21/00* (2006.01)

(52) U.S. Cl.
CPC ..... *F28F 1/325* (2013.01); *F28D 1/053* (2013.01); *F28D 2021/0068* (2013.01)

(58) Field of Classification Search
CPC ... F28F 1/325; F28D 1/053; F28D 2021/0068
See application file for complete search history.

(56) References Cited

U.S. PATENT DOCUMENTS

2013/0284416 A1* 10/2013 Jindou ..... F28F 1/12 165/181
2014/0116667 A1* 5/2014 Choi ..... F25B 39/00 165/172

(Continued)

FOREIGN PATENT DOCUMENTS

CN 103791659 A 5/2014
EP 2725311 A2 4/2014

(Continued)

OTHER PUBLICATIONS

Examination Report dated Jul. 15, 2021, issued in corresponding IN Patent Application No. 202027047967 (and English Machine Translation).

(Continued)

*Primary Examiner* — Devon Russell
(74) *Attorney, Agent, or Firm* — Posz Law Group, PLC

(57) ABSTRACT

A heat exchanger, a heat exchanger unit, and a refrigeration cycle apparatus are provided where deterioration in drainage and ventilation properties is prevented, an air passage is not easily clogged when frost forms, and both defrosting properties and heat exchange performance are achieved. A flat tube and a plurality of fins that are each a plate having a plate surface extending in a longitudinal direction and in a width direction orthogonal to the longitudinal direction are provided. The plate surface intersects a pipe axis of the flat tube. The plurality of fins each have an insertion portion in which the flat tube is inserted, a first spacer formed at a rim of the insertion portion and maintaining the interval, and a second spacer formed at a portion of the plate other than the rim of the insertion portion and maintaining the interval.

10 Claims, 10 Drawing Sheets

(56) References Cited

U.S. PATENT DOCUMENTS

| | | | | |
|---|---|---|---|---|
| 2014/0345312 | A1* | 11/2014 | Katoh | F28D 1/0408 62/277 |
| 2018/0299209 | A1* | 10/2018 | Etienne | F28F 1/325 |
| 2019/0137193 | A1* | 5/2019 | Yoshioka | F28F 1/02 |

FOREIGN PATENT DOCUMENTS

| | | | |
|---|---|---|---|
| FR | 3038976 | A1 | 1/2017 |
| JP | H03-095394 | A | 4/1991 |
| JP | H10-078295 | A | 3/1998 |
| JP | 2005-121288 | A | 5/2005 |
| JP | 2007-017042 | A | 1/2007 |
| JP | 2010-139115 | A | 6/2010 |
| JP | 2012-163318 | A | 8/2012 |
| JP | 5177307 | B2 | 4/2013 |
| JP | 2014-156990 | A | 8/2014 |
| JP | 2017-120134 | A | 7/2017 |
| JP | 2017-198440 | A | 11/2017 |

OTHER PUBLICATIONS

Office Action dated Sep. 26, 2021, issued in corresponding CN Patent Application No. 201880093622.X (and English Machine Translation).

Extended European Search Report dated Apr. 30, 2021, issued in corresponding European Patent Application No. 18922498.3.

Office Action dated May 11, 2021, issued in corresponding Japanese Patent Application No. 2020-525008 (and English Machine Translation).

Examination Report dated Aug. 9, 2021 issued in corresponding AU patent application No. 2018427606.

Examination Report dated Jan. 24, 2022 issued in corresponding AU patent application No. 2018427606.

International Search Report of the International Searching Authority dated Sep. 4, 2018 for the corresponding International application No. PCT/JP2018/022575 (and English translation).

* cited by examiner

Comparative Example

HEAT EXCHANGER, HEAT EXCHANGER UNIT, AND REFRIGERATION CYCLE APPARATUS

CROSS REFERENCE TO RELATED APPLICATION

This application is a U.S. national stage application of International Application No. PCT/JP2018/022575, filed on Jun. 13, 2018, the contents of which are incorporated herein by reference.

TECHNICAL FIELD

The present disclosure relates to a heat exchanger, a heat exchanger unit provided with the heat exchanger, and a refrigeration cycle apparatus, and particularly to a structure of a spacer that maintains an interval between fins installed on heat transfer tubes.

BACKGROUND

Some heat exchanger has been known that is provided with flat tubes, to improve heat exchange performance, that are each a heat transfer tube having a flat sectional shape with multiple holes. One example of such a heat exchanger is a heat exchanger where flat tubes are arranged at predetermined intervals from one another in the up-and-down direction with the direction of pipe axes extending in the lateral direction. In such a heat exchanger, plate-like fins are aligned in the direction of the pipe axes of the flat tubes, and heat is exchanged between air passing through between the fins and fluid flowing through the flat tubes. Some fin has been known that is provided with a fin collar at the rim of an insertion portion for the flat tube. The fin collar ensures a separation between the fins by causing the distal end of the fin collar to be in contact with the next fin. By maintaining an appropriate interval between the fins disposed next to each other, resistance against frost and drainage properties of the heat exchanger are ensured to prevent the reduction of heat exchange performance of the heat exchanger.

In Patent Literature 1, by raising opposite end portions, in the longitudinal direction, of the rim of an insertion portion, into which the flat tube is inserted, from the plate surface of the fin, the opposite end portions are in contact with the next fin. In Patent Literature 2, by raising a portion of the plate surface of the fin, which is a portion other than the rim of an insertion portion, the portion is caused to be in contact with the next fin. In Patent Literature 3, by raising a portion of the rim of an insertion portion for the flat tube, which is a portion that faces the long side of the section of the flat tube, the portion is caused to be in contact with the next fin.

PATENT LITERATURE

Patent Literature 1: Japanese Unexamined Patent Application Publication No. 10-78295
Patent Literature 2: Japanese Patent No. 5177307
Patent Literature 3: Japanese Unexamined Patent Application Publication No. 2017-198440

In Patent Literature 1, by raising the opposite end portions, in the longitudinal direction, of the rim of the insertion portion, a spacer is obtained that maintains the interval between the arranged fins and hence, a standing portion formed at a portion of the rim of the insertion portion that extends along the longitudinal direction is short. The standing portion is joined to the flat tube and transfers heat to the flat tube. A problem, however, is caused in that heat exchange performance is reduced as the standing portion is short.

In Patent Literature 2, another spacer that maintains the interval between the arranged fins is provided to a portion other than the rim of the insertion portion. As the spacer is disposed in an air passage between the fins, a problem is caused in that ventilation resistance increases in the heat exchanger and the ventilation resistance further increases during operation under the condition that outside air has a low temperature, where frost increases from the spacer used as a base point. Not only the spacer prevents drainage of condensation water or meltwater of frost through the air passage between the fins but also a problem is caused in that heat transfer performance of the fins reduces as a hole is provided in the plate surface of the fin.

In Patent Literature 3, by raising the portion of the rim of the insertion portion for the flat tube, which is a portion that faces the long side of the section of the flat tube, the spacer is formed. In recent years, however, as the thickness of the flat tube has been reduced, the width of the insertion portion is small and hence, it is difficult to raise the spacer from the plate surface of the fin up to a required height. In a case where the height of the spacer from the plate surface is insufficient, the interval between the fins disposed next to each other is small. Drainage properties of condensation water may thus reduce and ventilation properties may be reduced by, for example, the clogging of the air passage when frost forms. A problem therefore is caused in that the heat exchanger does not effectively produce heat exchange performance.

SUMMARY

The present disclosure has been made to solve the above-mentioned problems, and it is an object of the present disclosure to provide a heat exchanger, a heat exchanger unit, and a refrigeration cycle apparatus where deterioration in drainage properties and ventilation properties is prevented, an air passage is not easily clogged when frost forms, and both defrosting properties and heat exchange performance are achieved.

A heat exchanger according to one embodiment of the present disclosure includes a flat tube and a plurality of fins that are each a plate having a plate surface extending in a longitudinal direction and in a width direction orthogonal to the longitudinal direction. The plate surface intersects a pipe axis of the flat tube. The plurality of fins are arranged at an interval from one another. The plurality of fins each have an insertion portion in which the flat tube is inserted, a first spacer formed at a rim of the insertion portion and maintaining the interval, and a second spacer formed at a portion of the plate other than the rim of the insertion portion and maintaining the interval. The first spacer is positioned at one end portion in a longitudinal direction of a section of the rim of the insertion portion, and the section is perpendicular to the pipe axis of the flat tube.

A heat exchanger unit according to another embodiment of the present disclosure includes the above-mentioned heat exchanger, and a fan configured to send air to the heat exchanger. The above-mentioned first spacer is positioned upwind of the above-mentioned second spacer in a direction of a flow of air sent to the heat exchanger.

A refrigeration cycle apparatus according to still another embodiment of the present disclosure includes the above-mentioned heat exchanger unit.

According to an embodiment of the present disclosure, with the above-mentioned configuration, the interval between the fins is appropriately maintained. It is therefore possible to prevent the clogging of the air passage when frost forms, and drainage properties of meltwater are ensured during the defrosting process. Further, as the first spacer is positioned at an end portion of the insertion portion in the longitudinal direction of the flat tube, it is possible to prevent the reduction of ventilation properties between the fin and the flat tube. Resistance against frost and drainage properties of the heat exchanger and the heat exchanger unit are therefore enhanced while heat exchange performance is maintained.

DETAILED DESCRIPTION

Figure 1:
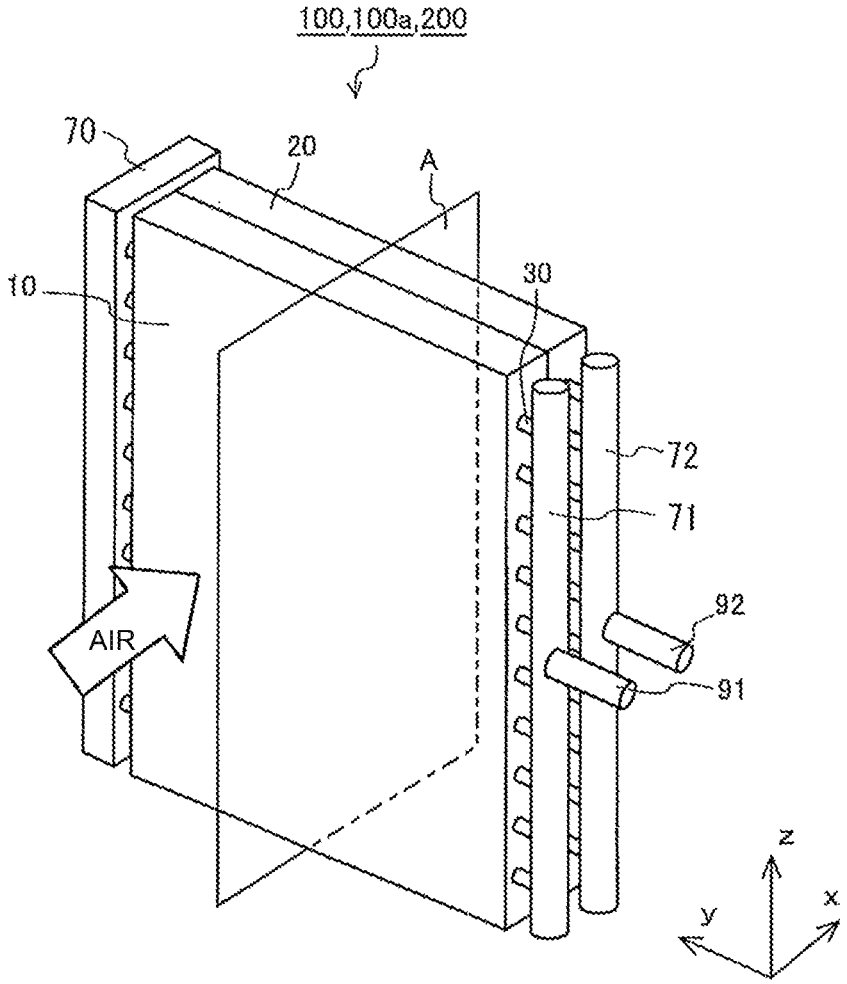
FIG. 1 is a perspective view showing a heat exchanger according to Embodiment 1.

Hereinafter, embodiments of a heat exchanger, a heat exchanger unit, and a refrigeration cycle apparatus are described. Hereinafter, the embodiments of the present disclosure are described with reference to drawings. In the drawings, components and portions given the same reference signs are the same or corresponding components and portions, and the reference signs are common in the entire specification. Further, forms of components described in the entire specification are merely examples, and the present disclosure is not limited to the description in the specification. In particular, the combination of the components is not limited to the combination in each embodiment, and components described in one embodiment may be applicable to another embodiment. Further, when it is not necessary to distinguish or specify a plurality of components or portions of the same kind that are, for example, differentiated by suffixes, the suffixes may be omitted. In the drawings, the relationship in size of the components and portions may differ from that of actual components and portions. It is noted that directions indicated by "x", "y", and "z" in the drawings indicate the same directions in the drawings.

Embodiment 1

Figure 2:
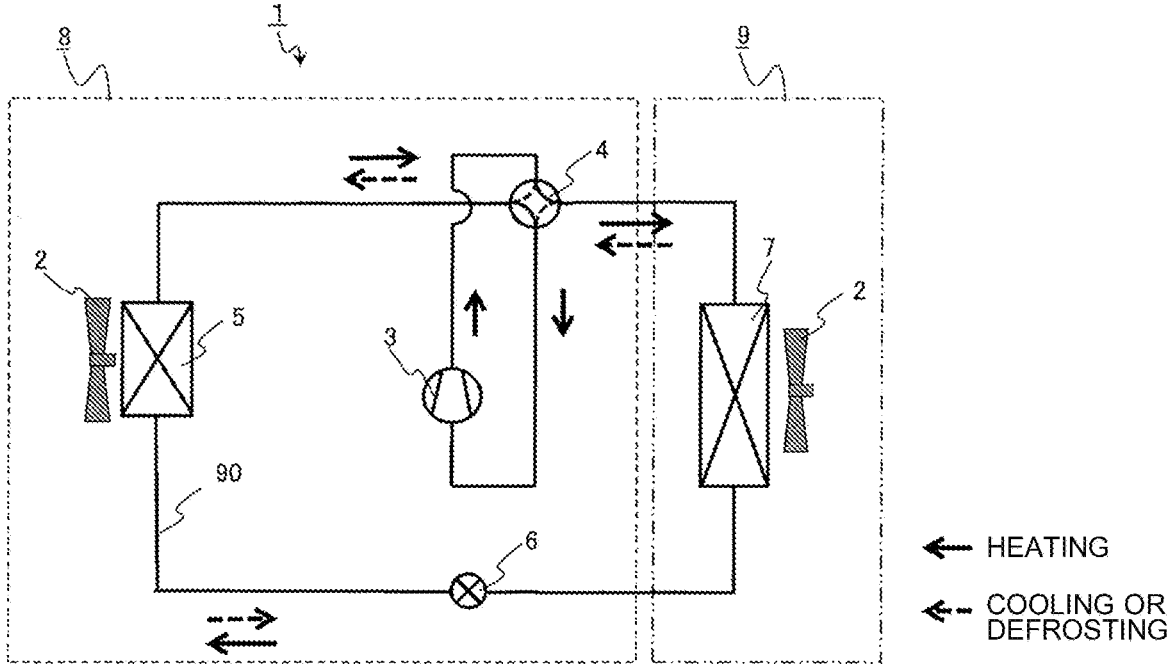
FIG. 2 is an explanatory view of a refrigeration cycle apparatus to which the heat exchanger according to Embodiment 1 is applied.

FIG. 1 is a perspective view showing a heat exchanger 100 according to Embodiment 1. FIG. 2 is an explanatory view of a refrigeration cycle apparatus 1 to which the heat exchanger 100 according to Embodiment 1 is applied. The heat exchanger 100 shown in FIG. 1 is a heat exchanger to be mounted on the refrigeration cycle apparatus 1, such as an air-conditioning apparatus and a refrigerator. In Embodiment 1, an air-conditioning apparatus is described as an example of the refrigeration cycle apparatus 1. The refrigeration cycle apparatus 1 has a configuration in which a compressor 3, a four-way valve 4, an outdoor heat exchanger 5, an expansion device 6, and an indoor heat exchanger 7 are connected by a refrigerant pipe 90 to form a refrigerant circuit. In the refrigeration cycle apparatus 1, refrigerant flows through the refrigerant pipe 90. By switching the flows of the refrigerant by the four-way valve 4, the operation of the refrigeration cycle apparatus 1 is switched to one of a heating operation, a refrigerating operation, and a defrosting operation.

The outdoor heat exchanger 5 is mounted on an outdoor unit 8, the indoor heat exchanger 7 is mounted on an indoor unit 9, and a fan 2 is disposed in the vicinity of each of the outdoor heat exchanger 5 and the indoor heat exchanger 7. In the outdoor unit 8, the fan 2 sends outside air into the outdoor heat exchanger 5 to exchange heat between the outside air and refrigerant. In the indoor unit 9, the fan 2 sends indoor air into the indoor heat exchanger 7 to exchange heat between the indoor air and refrigerant, so that the temperature of the indoor air is conditioned. Further, in the refrigeration cycle apparatus 1, the heat exchanger 100 may be used as the outdoor heat exchanger 5, mounted on the outdoor unit 8, or as the indoor heat exchanger 7, mounted on the indoor unit 9, and the heat exchanger 100 is used as a condenser or an evaporator. In the specification, a unit, such as the outdoor unit 8 and the indoor unit 9, on which the heat exchanger 100 is mounted is particularly referred to as "heat exchanger unit".

The heat exchanger 100 shown in FIG. 1 includes two heat exchange parts 10, 20. The heat exchange parts 10, 20 are arranged in series along the x direction shown in FIG. 1. The x direction is a direction perpendicular to a direction along which flat tubes 30 of the heat exchange part 10 are arranged in parallel and to a direction along which the pipe axes of the flat tubes 30 extend. In Embodiment 1, air flows into the heat exchanger 100 along the x direction. The heat exchange parts 10, 20 are consequently arranged in series along a direction along which air flows through the heat exchanger 100. The first heat exchange part 10 is disposed upwind, and the second heat exchange part 20 is disposed downwind. Headers 70, 71 are disposed at both ends of the heat exchange part 10, and the header 70 and the header 71 are connected with each other by the flat tubes 30. The header 70 and a header 72 are disposed at both ends of the heat exchange part 20, and the header 70 and the header 72 are connected with each other by the flat tubes 30. Refrigerant flowing into the header 71 from a refrigerant pipe 91 passes through the heat exchange part 10, flows into the heat exchange part 20 through the header 70, and flows out to a refrigerant pipe 92 from the header 72. The heat exchange part 10 and the heat exchange part 20 may have the same structure, or may have different structures.

Figure 3:
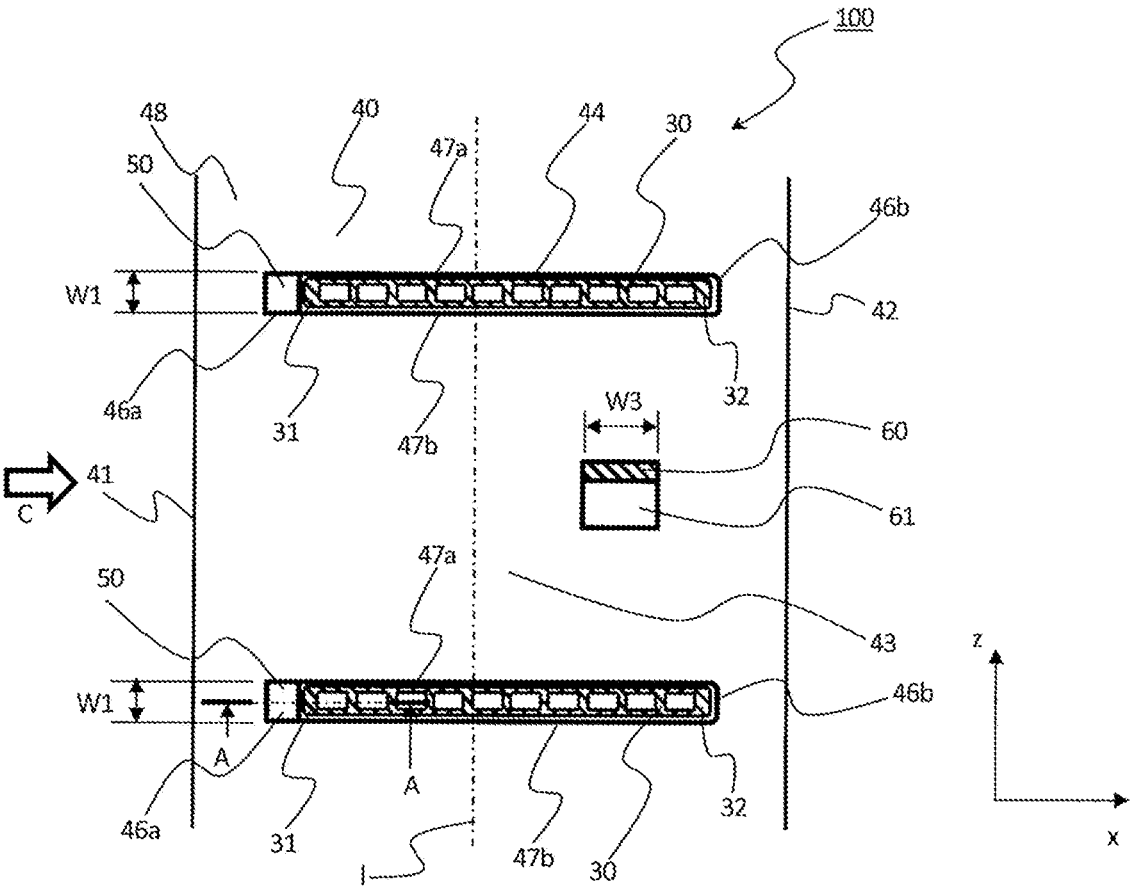
FIG. 3 is an explanatory view of the sectional structure of the heat exchanger shown in FIG. 1.

FIG. 3 is an explanatory view of the sectional structure of the heat exchanger 100 shown in FIG. 1. FIG. 3 is an explanatory view showing a portion of a section A of the heat exchange part 10 of the heat exchanger 100 shown in FIG. 1 as the section A perpendicular to the y axis is viewed from the y direction. The heat exchange part 10 has a configuration in which the plurality of flat tubes 30 are arranged in parallel in the z direction with the pipe axes of the flat tubes 30 extending in the y direction. Refrigerant flows through the flat tubes 30, so that heat is exchanged between air sent into the heat exchanger 100 and the refrigerant flowing through the flat tubes 30. Further, fins 40 are attached to the flat tubes 30 with a plate surface 48 of each fin 40, which is a plate, intersecting the pipe axes of the flat tubes 30. The fin 40 has a rectangular shape having the longitudinal direction of the fin 40 extending in a direction along which the flat tubes 30 are arranged in parallel. In other words, the fin 40 is provided with the longitudinal direction of the fin 40 extending along the z direction. The fin 40 is provided with an insertion portion 44 in which the flat tube 30 is inserted. In Embodiment 1, the insertion portion 44 is a long hole opened in the plate surface 48 of the fin 40. The flat tubes 30 are fitted in these insertion portions 44.

The width direction of the fin 40 means a direction perpendicular to the longitudinal direction of the fin 40, and extends along the x direction shown in FIG. 3. In Embodiment 1, air sent into the heat exchanger 100 flows in the x direction shown in FIG. 3, and an arrow C indicates the flow of air. The fin 40 includes a first end edge 41, which is one end edge in the width direction of the fin 40, positioned upwind in the direction of the flow of air and a second end edge 42, which is the other end edge in the width direction of the fin 40, positioned downwind in the direction of the flow of air. The insertion portion 44 is a long hole opened in the plate surface 48 and has the longitudinal direction of the long hole extending parallel to the width direction of the fin 40. The flat tube 30 also has the longitudinal axis of a section of the flat tube 30 perpendicular to the pipe axis extending parallel to the width direction of the fin 40.

The plurality of fins 40 are arranged along a direction along which the pipe axes of the flat tubes 30 extend. The fins 40 disposed next to each other are disposed with a predetermined gap between the plate surfaces 48 so that air is allowed to pass through between the plate surfaces 48. To ensure an interval between the fins 40 disposed next to each other, a first spacer 50 and a second spacer 60 are formed on the fins 40. Hereinafter, the first spacer 50 and the second spacer 60 may be collectively referred to as "spacer". The spacer is formed by bending a portion of the fin 40, which is a plate, and the spacer is erected in a direction intersecting the plate surface 48.

Figure 4:
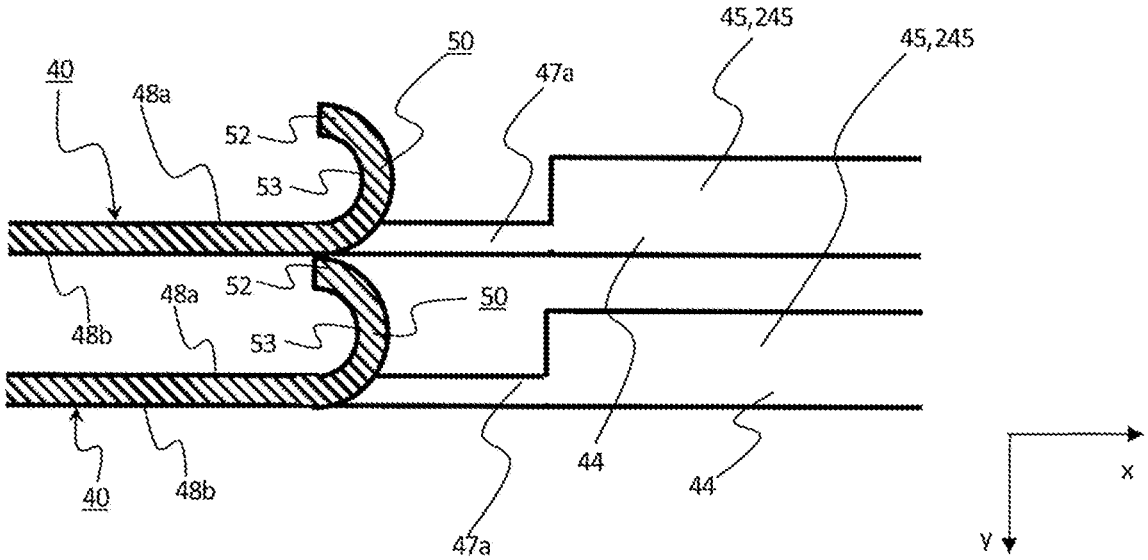
FIG. 4 is an enlarged sectional view of first spacers provided to fins of the heat exchanger according to Embodiment 1.

FIG. 4 is an enlarged sectional view of the first spacers 50 provided to the fins 40 of the heat exchanger 100 according to Embodiment 1. FIG. 4 corresponds to section A-A of the fin 40 shown in FIG. 3 and also includes the next fin 40. In FIG. 4, the flat tubes 30 are omitted. At an end portion 46*a* of the insertion portion 44 close to the first end edge 41, the first spacer 50 is erected toward the next fin 40, and the distal end of the first spacer 50 is in contact with a plate surface 48*b* of the next fin 40. The distal end of the first spacer 50 is bent to form a contact portion 52. In Embodiment 1, a standing surface 53 of the first spacer 50 is arc-shaped. However, the shape is not limited to an arc. For example, the standing surface 53 may be raised substantially perpendicular to a plate surface 48*a* and linearly formed.

As shown in FIG. 4, at a long side 47*a* in the rim of the insertion portion 44, a standing piece 45 is formed. The height of the standing piece 45 is lower than the height of the first spacer 50. The standing piece 45 is in contact with a side surface of the flat tube 30 that extends along the longitudinal axis of the section of the flat tube 30 and transfers heat between the fin 40 and the flat tube 30. The standing piece 45 and the flat tube 30 are joined by, for example, brazing. At a long side 47*b* shown in FIG. 3, a standing piece 45 is also formed similarly to the long side 47*a*. The long side 47*b* is formed symmetrically to the long side 47*a* across the center line extending along the longitudinal direction of the insertion portion 44.

Figure 5:
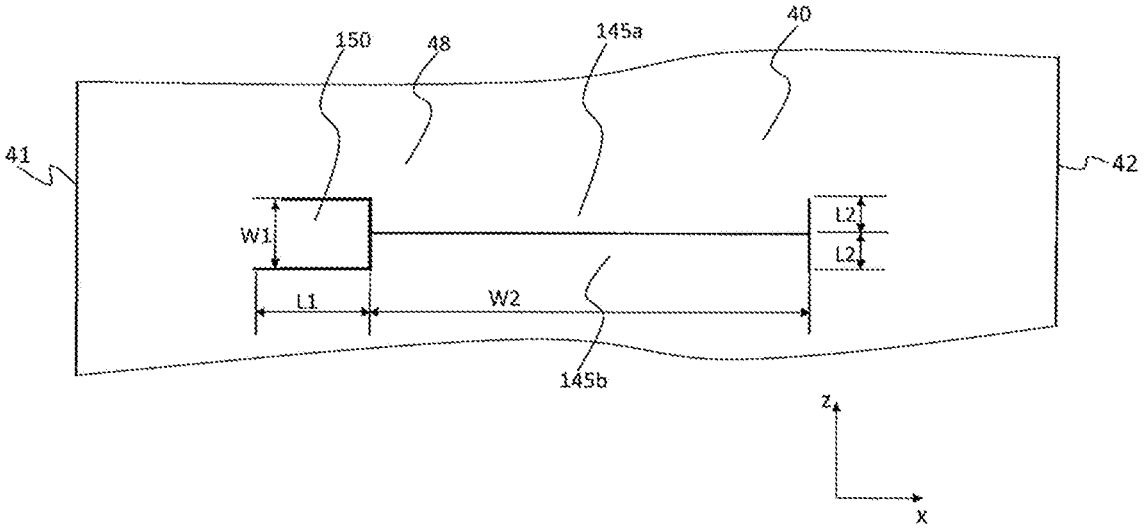
FIG. 5 is a plan view of a state where an insertion portion to be formed in the fin of the heat exchanger according to Embodiment 1 is yet to be formed.

FIG. 5 is a plan view of a state where the insertion portion 44 to be formed in the fin 40 of the heat exchanger 100 according to Embodiment 1 is yet to be formed. The insertion portion 44 is formed by raising tongue-shaped pieces obtaining by making cuts in the fin 40, which is a plate, in the normal direction of the plate surface 48*a*. The first spacer 50 is formed by raising a tongue-shaped piece 150 extending from one end close to the first end edge 41 to the other end close to the second end edge 42. The length L1 of the tongue-shaped piece 150 is set corresponding to the distance between the fins 40 of the heat exchanger 100. As the tongue-shaped piece 150 is shaped in such a manner that the tongue-shaped piece 150 extends in the longitudinal direction of the insertion portion 44, even in a case where the transverse axis of the flat tube 30 fitted in the insertion portion 44 is small, it is possible to set the tongue-shaped piece 150 to be long along the long sides 47*a*, 47*b*. Even in a case where the flat tube 30 is thin, the interval between the fins 40 may therefore be set to be large. Further, the width W1 of the tongue-shaped piece 150 is the width of the short side of the insertion portion 44 and is set in such a manner that it is possible to fit the flat tube 30 into the insertion portion 44.

The standing piece 45 formed to extend along each of the long sides 47*a*, 47*b* of the insertion portion 44 is formed by raising, from the plate surface 48, the corresponding one of tongue-shaped pieces 145*a*, 145*b* formed at a portion other than a portion in which the tongue-shaped piece 150 is formed. The tongue-shaped pieces 145*a*, 145*b* each extend in the longitudinal direction of the fin 40 and are each formed long in the width direction of the fin 40 to have the width W2. In FIG. 5, the tongue-shaped pieces 145*a*, 145*b* are each formed in a length of W1/2, which is a half of the short side of the insertion portion 44. As the length obtaining by adding the length L2 of the tongue-shaped piece 145*a* and the length L2 of the tongue-shaped piece 145*b* is at maximum the same length of the width W1 of the short side of the insertion portion 44, in the heat exchanger 100 according to Embodiment 1, the length L1 of the tongue-shaped piece 150, which is settable to be large, is adjusted in such a manner that the first spacer 50 is caused to be in contact with the next fin 40, to appropriately ensure the interval between fins 40.

Figure 6:
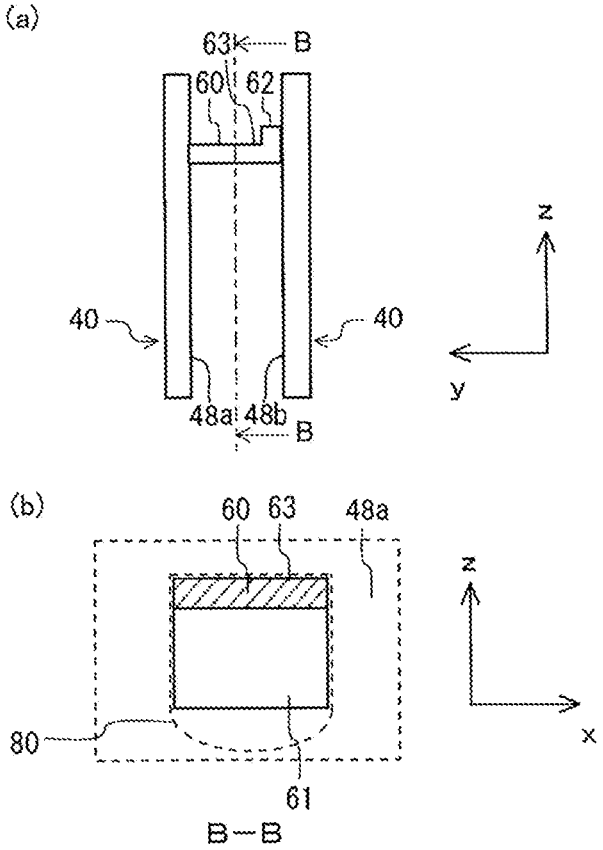
FIG. 6 includes enlarged views of a second spacer provided to the fin of the heat exchanger according to Embodiment 1.

FIG. 6 includes enlarged views of the second spacer 60 provided to the fin 40 of the heat exchanger 100 according to Embodiment 1. FIG. 6 (*a*) is an enlarged view as the second spacer 60 is viewed from the direction indicated by the arrow C in FIG. 3, and is an enlarged view as the second spacer 60 is viewed from a direction parallel to the plate surfaces 48 of the fins 40 and parallel to a standing surface 63 of the second spacer 60. FIG. 6 (*b*) is an explanatory view of the structure of the second spacer 60 as the second spacer 60 is viewed from a direction perpendicular to a section taken along B-B in FIG. 6 (*a*). The second spacer 60 is formed by bending a portion of the fin 40, which is a plate, and the second spacer 60 is erected in a direction intersecting the plate surface 48. The second spacer 60 is erected toward the next fin 40, and the distal end of the second spacer 60 is in contact with the plate surface 48*b* of the next fin 40. That is, the height of the second spacer 60 from the plate surface 48*a* to the distal end of the second spacer 60 is equally set as the height of the first spacer 50. The distal end of the second spacer 60 is bent to form a contact portion 62. In Embodiment 1, the standing surface 63 of the second spacer 60 is formed substantially perpendicular to the plate surface 48 of the fin 40. The second spacer 60 is formed by bending a portion of the fin 40 in a direction intersecting the plate surface 48. An opening port 61 is formed adjacent to the second spacer 60 in the opposite direction of the z direction of the second spacer 60.

Figure 7:
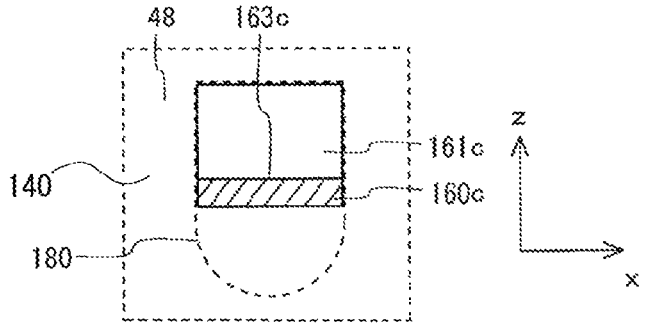
FIG. 7 is an explanatory view of a second spacer that is a comparative example of the second spacer formed on the fin of the heat exchanger according to Embodiment 1.

FIG. 7 is an explanatory view of a second spacer 160*c* that is a comparative example of the second spacer 60 formed on the fin 40 of the heat exchanger 100 according to Embodiment 1. FIG. 7 is an explanatory view as the second spacer 160*c* is viewed in the same direction as FIG. 6 (*b*). The second spacer 160*c* of the comparative example is formed by bending a portion of a fin 140 in the opposite direction of the z direction in FIG. 7. In other words, when the heat exchanger 100 is installed with the opposite direction of the z direction in FIG. 7 aligning with the direction of gravity, the second spacer 160*c* is formed by bending the portion of the fin 140 in the direction of gravity. A standing surface 163*c* is formed substantially perpendicular to the plate surface 48. In this case, an opening port 161*c* is formed over the second spacer 160*c*. When condensation water or meltwater of frost flows down to the second spacer 160*c*, not only water stays on the standing surface 163*c*, but also water adheres to the edge of the opening port 161*c* because of capillarity. Further, water drops also adhere to a portion under the second spacer 160*c* in such a manner that the water drops hang from the portion under the second spacer 160*c*, so that the second spacer 160*c* and the opening port 161*c* maintain water in a region surrounded by a dotted line 180 in FIG. 7. In contrast, water drops adhere to the second spacer 60 and the opening port 61 according to Embodiment 1 in such a manner that the water drops hang from a portion under the second spacer 60 as shown by a dotted line 80 in FIG. 6 (*b*). The amount of water maintained at the second spacer 60 and the opening port 61 is consequently small compared with that maintained at the second spacer 160 and the opening port 161 of the comparative example. In other words, the second spacer 60 and the opening port 61 according to Embodiment 1 maintains less amount of water and has higher drainage properties compared with the second spacer 160 and the opening port 161 of the comparative example.

As shown in FIG. 3, in Embodiment 1, the second spacer 60 is provided in an intermediate region 43 between two flat tubes 30. In the width direction of the fin 40, the second spacer 60 is positioned close to the second end edge 42 and the first spacer 50 is positioned close to the first end edge 41. In addition, the first spacer 50 and the second spacer 60 are positioned away from each other across a line I. The line I passes through the center of gravity of the fin 40 as the fin 40 is viewed from the y direction and extends parallel to the longitudinal direction of the fin 40. In the specification, the line I is referred to as "gravity center axis". In other words, the gravity center axis intersects an imaginary line connecting the first spacer 50 and the second spacer 60. With this configuration, the fins 40 are stably stacked on one another and an advantageous effect is obtained that the assembly workability increases in assembling the heat exchanger 100. In addition, the first spacer 50 and the second spacer 60 are disposed with an interval between the first spacer 50 and the second spacer 60 in the width direction of the fin 40 and hence, the interval between the fins 40 is stably ensured.

In addition, one second spacer 60 is disposed in the intermediate region 43 between the flat tubes 30 disposed next to each other in FIG. 3, the second spacer 60, however, is not always required to be disposed in each of all the intermediate regions 43. By lessening the number of the second spacers 60 disposed to be smaller than the number of the first spacers 50 disposed, ventilation properties of the heat exchanger 100 are increased and the interval between the fins 40 disposed next to each other is stably ensured.

The first spacer 50 is positioned upwind of the second spacer 60 in the direction of the flow of air flowing in in the x direction. The difference in temperature between air passing through the heat exchanger 100 and a region close to the first end edge 41 of the fin 40 positioned upwind in the direction of the flow of air is larger than the difference in temperature between air passing through the heat exchanger 100 and a region close to the second end edge 42 of the fin 40 positioned downwind in the direction of the flow of air. At the region close to the first end edge 41, heat is therefore easily exchanged between the fin 40 and the air. As the second spacer 60 is positioned in a region other than the region close to the first end edge 41 of the fin 40, where heat is thus easily exchanged, even with the second spacer 60 disposed, the reduction of heat exchange performance of the heat exchanger 100 is prevented. Further, in a case where the heat exchanger 100 is operated as an evaporator under the condition that outside air has a low temperature, frost easily forms on an upwind portion of the heat exchanger 100, where the difference in temperature between the upwind portion and air is large. By disposing the second spacer 60 downwind of the first spacer 50, increase of frost from the second spacer 60 used as a base point is prevented and the interval between the fins 40 is appropriately ensured. It is therefore possible to prevent the reduction of ventilation properties of the heat exchanger 100 and appropriately ensure heat exchange performance of the heat exchanger 100.

When the fin 40 is viewed in the y direction, that is, when the fin 40 is viewed in a direction perpendicular to the plate surface 48, the standing surface 63 of the second spacer 60 extends parallel to the width direction of the fin 40. The configuration, however, is not limited to the above-mentioned configuration. The standing surface 63 of the second spacer 60 may be inclined. In this case, as condensation water or meltwater of frost flowing down from an upper portion of the fin 40 flows from the standing surface 63 in the direction of gravity, stagnation of water on the standing surface 63 is prevented to obtain an advantageous effect that drainage properties of the heat exchanger 100 increases.

In addition, the width W3 of the second spacer 60 may be smaller than the width W1 of the first spacer 50. As the width of the standing surface 63 of the second spacer 60 is small, ventilation resistance between the fins 40 of the heat exchanger 100 reduces and ventilation properties of the heat exchanger 100 are therefore increased. In addition, as the opening port 61 in the plate surface 48 of the fin 40 is also small, it is possible to prevent the reduction of heat exchange performance.

The second spacer 60 may be disposed in a region between second end portions 32 and the second end edge 42 of the fin 40, and each second end portion 32 of the flat tube 30 is disposed downwind in the width direction of the fin 40. By disposing the second spacer 60 further downwind than is the flat tube 30, it is possible to prevent the reduction of heat exchange performance of the heat exchanger 100 caused by the provision of the second spacer 60.

<Modification of Second Spacer 60>

Figure 8:
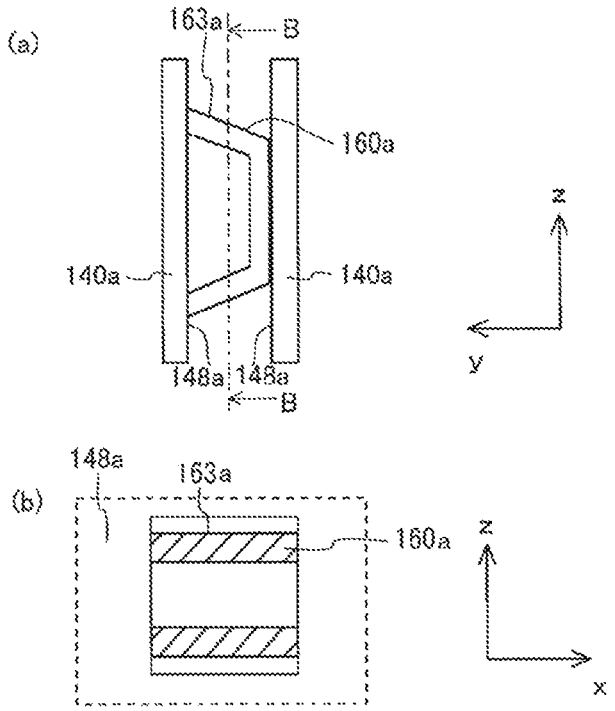
FIG. 8 includes explanatory views of a second spacer that is a modification of the second spacer formed on the fin of the heat exchanger according to Embodiment 1.

FIG. 8 includes explanatory views of a second spacer 160*a* that is a modification of the second spacer 60 formed on the fin 40 of the heat exchanger 100 according to Embodiment 1. FIG. 8 (*a*) corresponds to FIG. 6 (*a*), and FIG. 8 (*b*) corresponds to FIG. 6 (*b*). The second spacer 60 provided to the fins 40 of the heat exchanger 100 according to Embodiment 1 may have the structure of the second spacer 160*a* as shown in FIG. 8, for example. The second spacer 160*a* is formed in such a manner that two slits are formed in a plate surface 148*a* of the fin 140, and a portion between these slits is caused to protrude from the plate surface 148*a*. The second spacer 160*a* is consequently connected with the plate surface 148*a* at two positions. In FIG. 8, an upper surface of the second spacer 160*a* is a standing surface 163*a*. In the same manner as the standing surface 63 of the second spacer 60, the standing surface 163*a* extends parallel to the width direction of the fin 140 when the standing surface 163*a* is viewed in the y direction.

Figure 9:
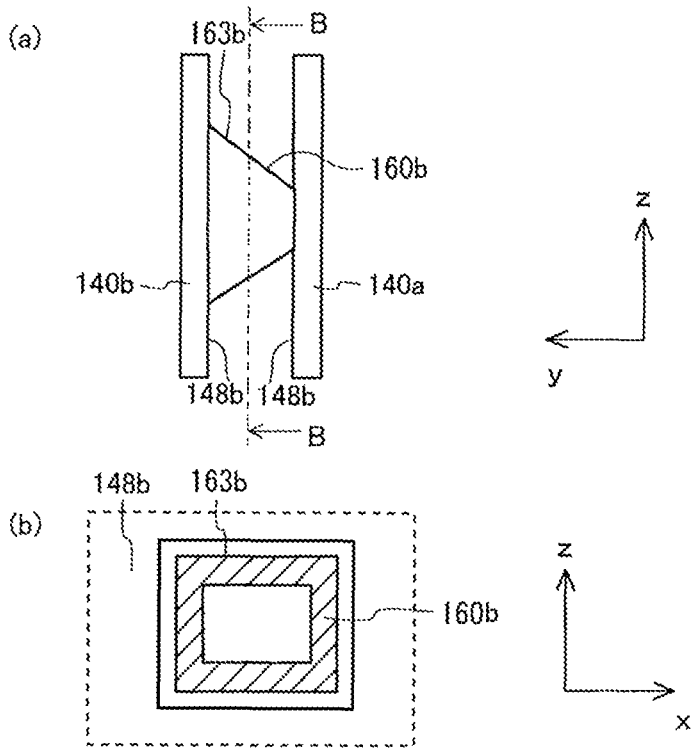
FIG. 9 includes explanatory views of a second spacer that is a modification of the second spacer formed on the fin of the heat exchanger according to Embodiment 1.

FIG. 9 includes explanatory views of a second spacer 160*b* that is a modification of the second spacer 60 formed on the fin 40 of the heat exchanger 100 according to Embodiment 1. FIG. 9 (*a*) corresponds to FIG. 6 (*a*), and FIG. 9 (*b*) corresponds to FIG. 6 (*b*). The second spacer 160*b* is formed in such a manner that the second spacer 160*b* is caused to protrude from a plate surface 148*b* of the fin 140 in a rectangular shape. In FIG. 9, an upper surface of the second spacer 160*b* is a standing surface 163*b*. In the same manner as the standing surface 53 of the second spacer 60, the standing surface 163*b* extends parallel to the width direction of the fin 140 when the standing surface 163*b* is viewed in the y direction.

<Advantageous Effects of Embodiment 1>

In the heat exchanger 100 according to Embodiment 1, as the first spacer 50 is disposed at the end portion 46*a* in the longitudinal direction in the rim of the insertion portion 44 provided to the fin 40, it is possible to suitably set the height of the first spacer 50 from the plate surface 48 to the distal end of the first spacer 50. For example, even in the case where the transverse axis of the flat tube 30 is short, as the height of the first spacer 50 is ensured, it is possible to appropriately ensure the interval between the fins 40. The reduction of the amount of refrigerant filled in the refrigeration cycle apparatus 1 is required to reduce global warming. As it is possible to set the transverse axis of the flat tube 30 to have a small value, the heat exchanger 100 is effective to reduce the amount of filled refrigerant.

The first spacer 50 is disposed upwind of a first end portion 31 of the flat tube 30. No possibility consequently remains that ventilation properties of the air passage between the fins 40 are impaired. It is therefore possible to appropriately ensure a gap between the fins 40 by the first spacer 50 while ventilation resistance between the fins 40 is not increased.

As the first spacer 50 is disposed only at the end portion 46*a*, which is one end portion of the insertion portion 44 in the longitudinal direction, it is possible to dispose the standing piece 45 at a portion other than the vicinity of the end portion 46*a*. It is therefore possible to set an area on which the flat tube 30 and the standing piece 45 are in contact with each other to be large compared with a case where the first spacer 50 is disposed at each of the opposite end portions of the insertion portion 44 in the longitudinal direction. Heat transfer between the flat tube 30 and the fin 40 is consequently facilitated and heat exchange performance of the heat exchanger 100 increases.

Figure 10:
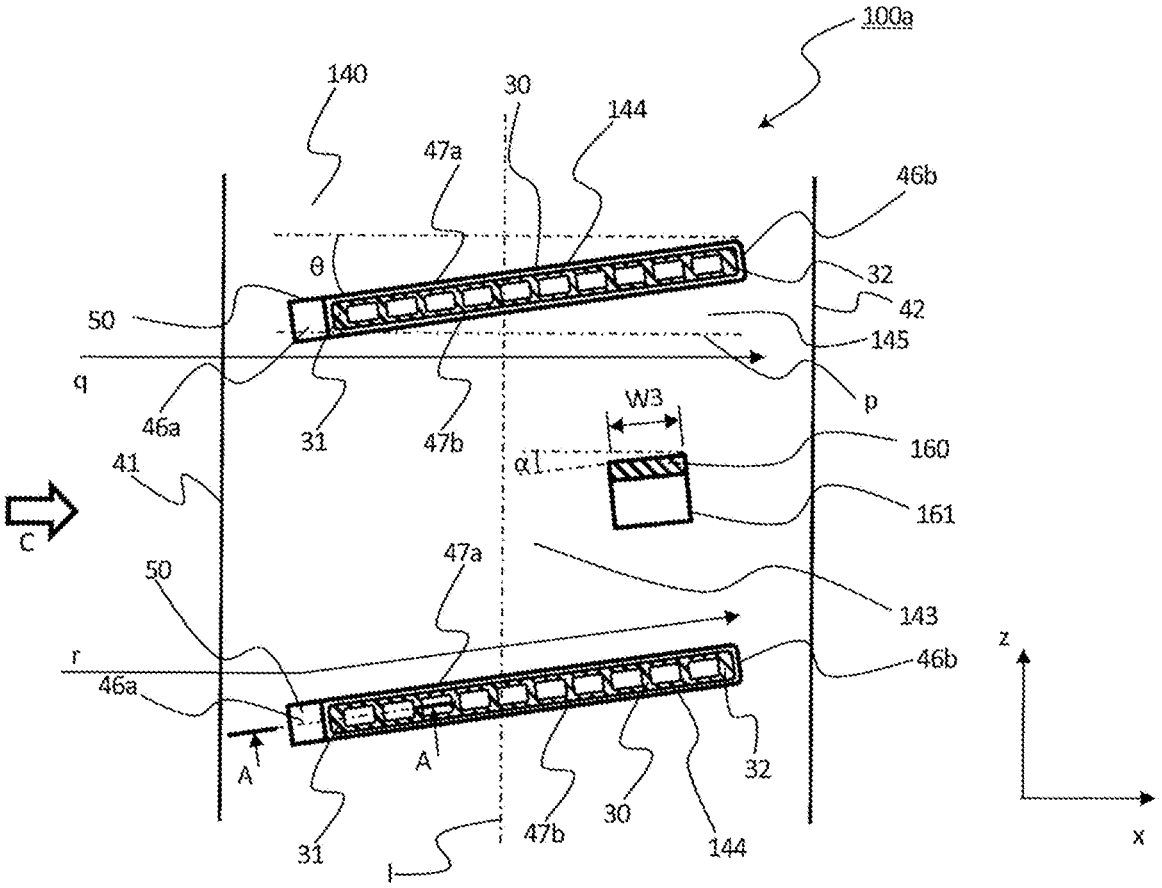
FIG. 10 is an explanatory view of the sectional structure of a heat exchanger that is a modification of the heat exchanger according to Embodiment 1.

FIG. 10 is an explanatory view of the sectional structure of a heat exchanger 100*a* that is a modification of the heat exchanger 100 according to Embodiment 1. The longitudinal axis of the flat tube 30 in the heat exchanger 100 according to Embodiment 1 may be disposed and inclined to the width direction of the fin 40. As shown in FIG. 10, the first end portion 31 positioned closer to the first end edge 41 of the fin 140 than is the second end portion 32 is positioned lower than is the second end portion 32 positioned closer to the second end edge 42 than is the first end portion 31. In this case, an insertion portion 144 disposed in the fin 140 is also disposed and inclined to the width direction of the fin 140 by the inclination angle θ. A second spacer 160 is also disposed and inclined by the inclination angle θ. With such a configuration, water flowing down from an upper portion of the fin 140 is easily drained from an upper surface of the flat tube 30 and an upper surface of the second spacer 160 to improve drainage properties of the heat exchanger 100*a*. In addition, the insertion portion 144 and the second spacer 160 are inclined in the same direction. With such a configuration, it is possible to dispose the second spacer 60 while ventilation resistance of the air passage between the flat tubes 30 disposed next to each other is not increased.

The description has been made above for a state where air flows into the heat exchanger 100*a* from a direction perpendicular to the first end edge 41 of the fin 140 of the heat exchanger 100*a*. However, there may be also a case where the heat exchanger 100*a* is disposed and inclined to the direction of gravity, for example. In Embodiment 1, the direction of gravity extends downward along the z axis. The heat exchanger 100, 100*a*, however, may be disposed to have the z axis inclined to the direction of gravity. The inclination angle of each of the flat tubes 30 and the second spacer 60 is only required to be suitably set corresponding to an environment where the heat exchanger 100, 100*a* is disposed.

The second spacer 60 may be disposed in a shielded region 145. The shielded region 145 is, within an intermediate region 143 between two insertion portions 144 of the heat exchanger 100*a*, a region between an imaginary line p and a lower surface of the flat tube 30. The imaginary line p is drawn horizontal to the width direction of the fin 140 from a lower end of the first end portion 31 of the flat tube 30. When air flows into the heat exchanger 100*a* across the first end edge 41 of the fin 140 in the x direction, the shielded region 145 is a region shielded by the flat tube 30 disposed and inclined. In a case where the flat tube 30 is disposed as shown in FIG. 10, air flowing over the upper surface of the flat tube 30 flows along the upper surface of the flat tube 30 as illustrated by an arrow r shown in FIG. 10. The direction of air flowing under the lower surface of the flat tube 30, however, is not easily changed as illustrated by an arrow q shown in FIG. 10, so that the shielded region 145 is a region where the flow of air stagnates. As the second spacer 160 is disposed in the shielded region 145, ventilation properties of the air passage between the fins 140 are therefore less affected.

Embodiment 2

A heat exchanger 200 according to Embodiment 2 is a heat exchanger obtained by changing the structure of the insertion portion 44 from that in the heat exchanger 100 according to Embodiment 1. The description of the heat exchanger 200 according to Embodiment 2 is made below mainly for points different from Embodiment 1. In the drawings, portions of the heat exchanger 200 according to Embodiment 2 having the same functions as those in Embodiment 1 are given the same reference signs as used in the drawings for describing Embodiment 1.

Figure 11:
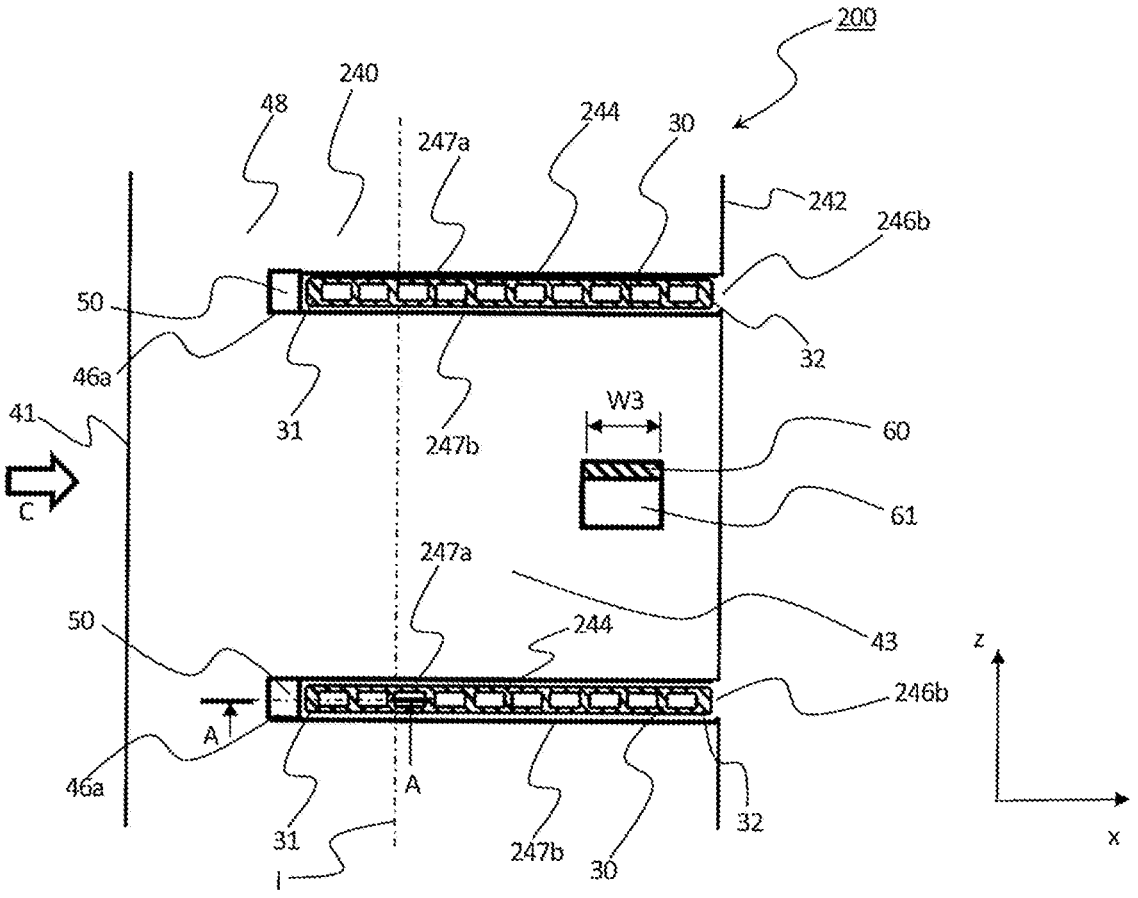
FIG. 11 is an explanatory view of the sectional structure of a heat exchanger according to Embodiment 2.

FIG. 11 is an explanatory view of the sectional structure of the heat exchanger 200 according to Embodiment 2. FIG. 11 is an explanatory view showing a portion of a section A of the heat exchange part 10 of the heat exchanger 200 shown in FIG. 1 as the section A perpendicular to the y axis is viewed from the y direction. In Embodiment 2, insertion portions 244 are disposed in a fin 240, which is a plate, included in the heat exchange part 10. The insertion portions 244 are each a cut-out in a second end edge 242 of the fin 240. The flat tubes 30 are fitted in these cut-outs. The insertion portion 244 has the longitudinal direction extending parallel to the width direction of the fin 240. The flat tube 30 also has the longitudinal axis of a section of the flat tube 30 perpendicular to the pipe axis extending parallel to the width direction of the fin 240.

The first spacer 50 provided to the fin 240 of the heat exchanger 200 according to Embodiment 2 has the same structure as that of the heat exchanger 100 shown in FIG. 4. FIG. 4 corresponds to section A-A shown in FIG. 11. Long side portions 247*a*, 247*b* are in the rim of the insertion portion 244, and a standing piece 245 is formed at the each of the long side portions 247*a*, 247*b*, similarly to Embodiment 1. The height of the standing piece 245 is lower than the height of the first spacer 50. The standing piece 245 is in contact with a side surface of the flat tube 30 that extends along the longitudinal axis of the section of the flat tube 30 and transfers heat between the fin 240 and the flat tube 30. The standing piece 245 and the flat tube 30 are joined by, for example, brazing.

Figure 12:
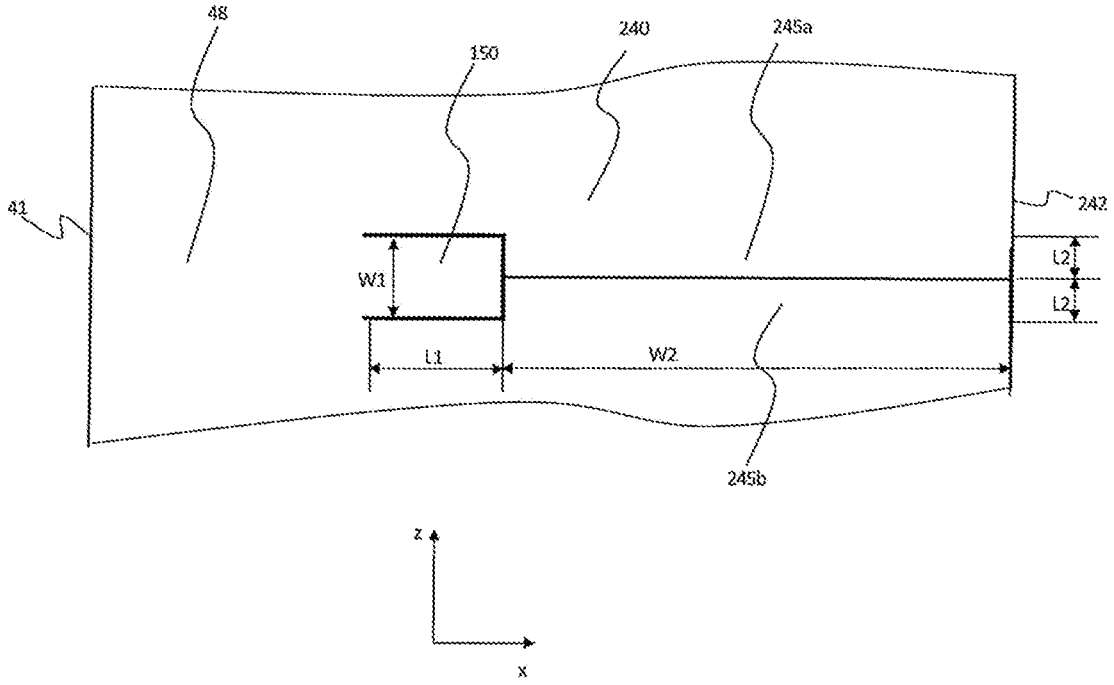
FIG. 12 is a plan view of a state where an insertion portion to be formed in a fin of the heat exchanger according to Embodiment 2 is yet to be formed.

FIG. 12 is a plan view of a state where the insertion portion 244 to be formed in the fin 240 of the heat exchanger 200 according to Embodiment 2 is yet to be formed. The insertion portion 244 is formed by raising tongue-shaped pieces obtaining by making cuts in the fin 240, which is a plate, in the normal direction of the plate surface 48. The first spacer 50 is formed by raising the tongue-shaped piece 150 extending from one end close to the first end edge 41 to the other end close to the second end edge 242.

The standing piece 245 formed to extend along each of the long side portions 247*a*, 247*b* of the insertion portion 244 is the corresponding one of tongue-shaped pieces 245*a*, 245*b* formed at a portion other than a portion in which the tongue-shaped piece 150 is formed. The tongue-shaped pieces 245*a*, 245*b* each extend in the longitudinal direction of the fin 240 and are each formed long in the width direction of the fin 240 to have the width W2. In FIG. 12, the tongue-shaped pieces 245*a*, 245*b* are each formed in a length of W1/2, which is a half of the short side of the insertion portion 244. As the length obtaining by adding the length L2 of the tongue-shaped piece 245*a* and the length L2 of the tongue-shaped piece 245*b* is at maximum the same length of the width W1 of the short side of the insertion portion 244, in the heat exchanger 200 according to Embodiment 2, the length L1 of the tongue-shaped piece 150, which is settable to be large, is adjusted in such a manner that the first spacer 50 is caused to be in contact with the next fin 240, to appropriately ensure the interval between the fins 240.

<Advantageous Effects of Embodiment 2>

In the heat exchanger 200 according to Embodiment 2, as the first spacer 50 is disposed at the end portion 46*a* in the longitudinal direction in the rim of the insertion portion 244 provided to the fin 240, it is possible to suitably set the height of the first spacer 50 from the plate surface 48 to the distal end of the first spacer 50, to appropriately ensure the interval between the fins 240 disposed next to each other. In addition, as the insertion portions 244 are each a cut-out in the second end edge 242, it is possible to insert the flat tubes 30 into the insertion portions 244 of the fin 240 from the second end edge 242. In manufacturing the heat exchanger 200, the fins 240 and the flat tubes 30 are easily assembled. Further, in a case where the fin 40 according to Embodiment 1 and the fin 240 according to Embodiment 2 have the same width, it is possible to set the distance between the first end portion 31 of the flat tube 30 and the first end edge 41 of the fin 240 to be larger than that of the fin 40. In a case where the heat exchanger 200 is disposed in such a manner that the first end edge 41 of the fin 240 is disposed upwind and the refrigeration cycle apparatus 1 is operated under the condition that outside air has a low temperature, it is therefore possible to reduce frost forming in a region close to the first end edge 41 of the fin 240.

In addition, similarly to Embodiment 1, the flat tube 30 in the heat exchanger 200 according to Embodiment 2 may also be inclined to the width direction of the fin 240. In this case, the second spacer 60 may also be inclined to the width direction of the fin 240. With such a configuration, water flowing down from the upper portion of the fin 240 is easily drained from the upper surface of the flat tube 30 and the upper surface of the second spacer 60 to improve drainage properties of the heat exchanger 200.

Figure 13:
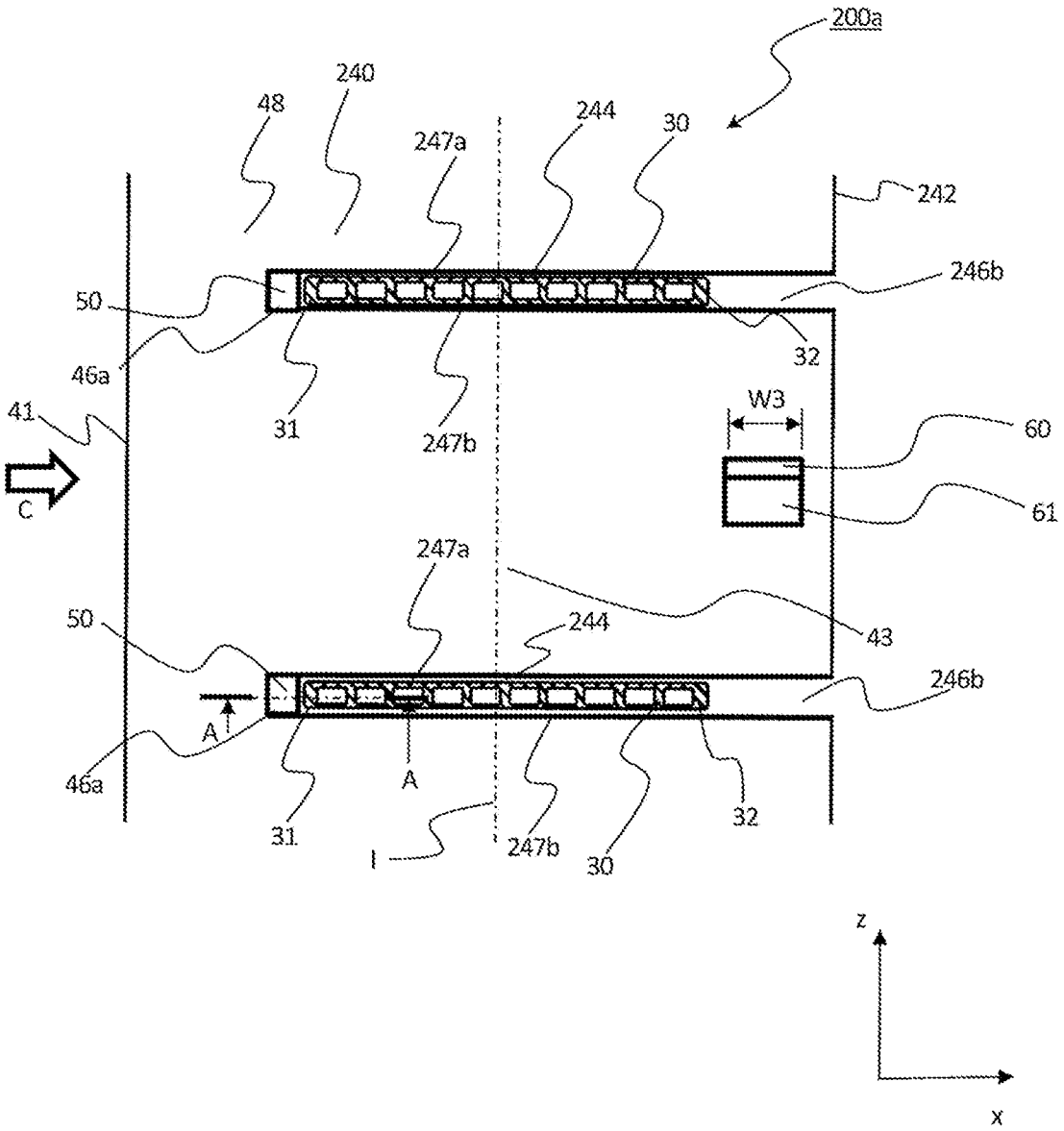
FIG. 13 is an explanatory view of the sectional structure of a heat exchanger that is a modification of the heat exchanger according to Embodiment 2.

FIG. 13 is an explanatory view of the sectional structure of a heat exchanger 200*a* that is a modification of the heat exchanger 200 according to Embodiment 2. The heat exchanger 200*a* of the modification is obtained by causing the fin 240 to extend farther in the downwind direction than the second end portions 32 of the flat tubes. As the shape of the fin 240 is caused to extend in the downwind direction, the insertion portions 244 are also formed to extend in the downwind direction. Nothing is disposed in a region of the insertion portion 244 at a portion close to the second end edge 242. In the heat exchanger 200 according to Embodiment 2, the second end edge 242 and the second end portions 32 of the flat tubes 30 are disposed at substantially the same position in the x direction. In contrast, in the heat exchanger 200*a* of the modification, the second end edge 242 of the fin 240 is positioned away from the second end portions 32 of the flat tubes 30 in the x direction. In addition, the second spacer 60 is disposed in a region between the second end portions 32 and the second end edge 242 of the fin 240, and each second end portion 32 of the flat tube 30 is disposed downwind in the width direction of the fin 240. By disposing the second spacer 60 downwind of the flat tube 30, it is possible to prevent the reduction of heat exchange performance of the heat exchanger 200*a* caused by the provision of the second spacer 60.

The invention claimed is:

1. A heat exchanger, comprising:

a flat tube; and a plurality of fins each comprising a plate having a plate surface extending in a longitudinal direction and in a width direction orthogonal to the longitudinal direction, the plate surface intersecting a pipe axis of the flat tube, the plurality of fins being arranged at an interval from one another, the plurality of fins each having an insertion portion in which the flat tube is inserted, a first spacer formed at a rim of the insertion portion and maintaining the interval, and a second spacer formed at a portion of the plate other than the rim of the insertion portion and maintaining the interval, the first spacer being positioned at one end portion of the rim in a longitudinal direction of the insertion portion, the longitudinal direction being perpendicular to the pipe axis of the flat tube, wherein the first spacer is a raised tongue-shaped piece bent across a width of a short side of the insertion portion, the first spacer extending in the longitudinal direction of the insertion portion and positioned at one end of the insertion portion.

2. The heat exchanger of claim 1, wherein a height of the first spacer from the plate surface to a distal end of the first spacer and a height of the second spacer from the plate surface to a distal end of the second spacer are each larger than a transverse axis of a section of the flat tube, the section being perpendicular to the pipe axis of the flat tube.

3. The heat exchanger of claim 1, wherein the second spacer is disposed downwind of the first spacer in a direction of a flow of air passing through between the plurality of fins.

4. The heat exchanger of claim 1, wherein the number of the second spacers disposed is smaller than the number of the first spacers disposed.

5. The heat exchanger of claim 1, wherein a width of the second spacer is smaller than a width of the first spacer.

6. The heat exchanger of claim 1, wherein a gravity center axis passing through a gravity center of each of the plurality of fins and extending parallel to the longitudinal direction of each of the plurality of fins intersects an imaginary line connecting the first spacer and the second spacer when the gravity center axis is viewed from a direction perpendicular to the plate surface.

7. The heat exchanger of claim 1, wherein the insertion portion is a cut-out extending from one end edge of each of the plurality of fins in the width direction of each of the plurality of fins.

8. The heat exchanger of claim 1, wherein the insertion portion is inclined to the width direction of each of the plurality of fins.

9. A heat exchanger unit, comprising:

the heat exchanger of claim 1; and a fan configured to send air to the heat exchanger, the first spacer being positioned upwind of the second spacer in a direction of a flow of air sent to the heat exchanger.

10. A refrigeration cycle apparatus comprising the heat exchanger unit of claim 9.

* * * * *